United States Patent [19]

Hall

[11] 3,946,849

[45] Mar. 30, 1976

[54] COIN-CHUTE FOR TESTING THE FERROUS CONTENT, WEIGHT, AND PRESENCE OF AN APERTURE IN COINS

[75] Inventor: Mitchell A. Hall, Fort Thomas, Ky.

[73] Assignee: Monarch Tool & Manufacturing Company, Covington, Ky.

[22] Filed: June 9, 1975

[21] Appl. No.: 584,774

[52] U.S. Cl. ..... 194/97 B; 194/99; 194/101; 194/103

[51] Int. Cl.[2] ..... G07F 3/02

[58] Field of Search ..... 194/97, 97 B, 101, 102, 194/103, 99

[56] References Cited

UNITED STATES PATENTS

| | | | |
|---|---|---|---|
| 483,188 | 9/1892 | Volkmann | 194/99 |
| 2,287,292 | 6/1942 | Bugg | 194/103 X |
| 2,349,214 | 5/1944 | Vieth | 194/101 |
| 2,630,200 | 3/1953 | Hehn | 194/101 |
| 2,975,880 | 3/1961 | Gabrielsen | 194/99 |

*Primary Examiner*—Robert B. Reeves
*Assistant Examiner*—Francis J. Bartuska
*Attorney, Agent, or Firm*—J. Warren Kinney, Jr.

[57] ABSTRACT

An inclined coin chute includes devices for testing the ferrous content of, the weight of, and the presence or lack of a central aperture in coin-tokens which are present in and advancing through the coin-receptive chutes of the inclined coin-chute, wherein the testing devices are operable to intercept and eject spurious coin-tokens from the coin-chute.

23 Claims, 12 Drawing Figures

P
N
D
Q
20
24
22
82
80
76
78
48
54
55
56
72
28
57
96
92
94
90
26
84
115
114
60
73
62
108
110
106
112
113
116
100
50
52
65
64
30
32
33
34
36
37
38
39
42
44
46
31

4
67
68
69
F
28
26
20
34
24
36
37
62
58
a
REJECT
ACCEPT
122

57
24
50
58
62
65
64
70
Q
67
22
44
42
124
123
37
36
30
33
46
34
62

67
70
F
82
80
78
22
76
42
120
44
36
37
33
30
46
34
62

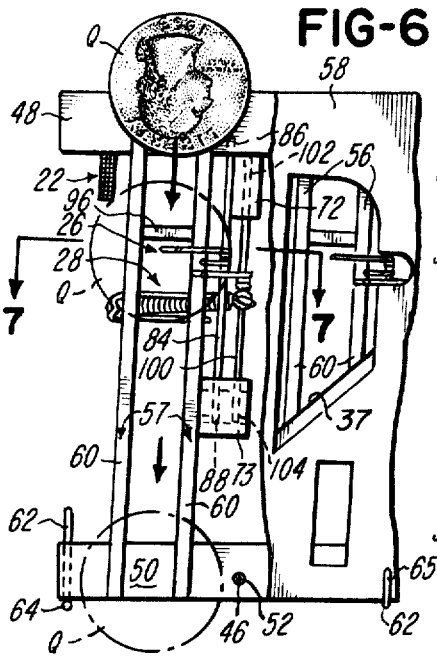
FIG-6
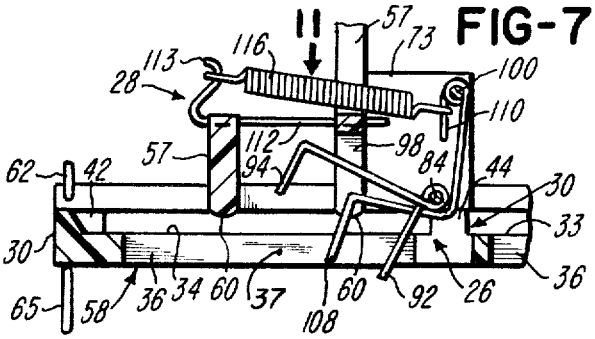
FIG-7
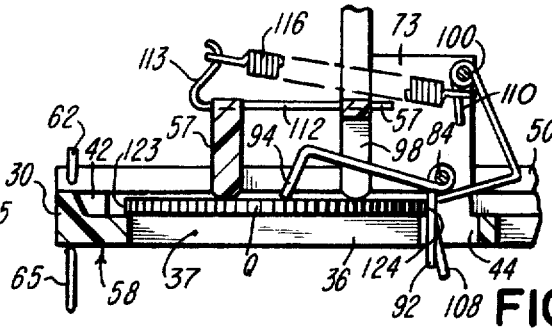
FIG-8
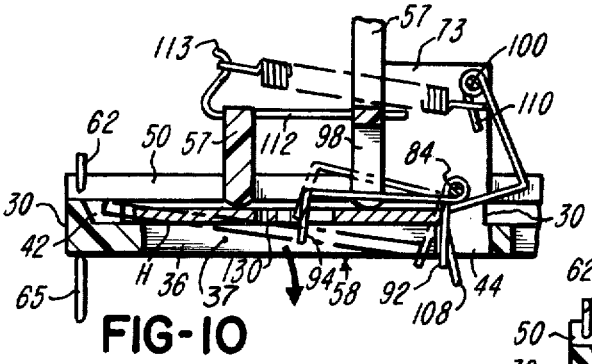
FIG-10
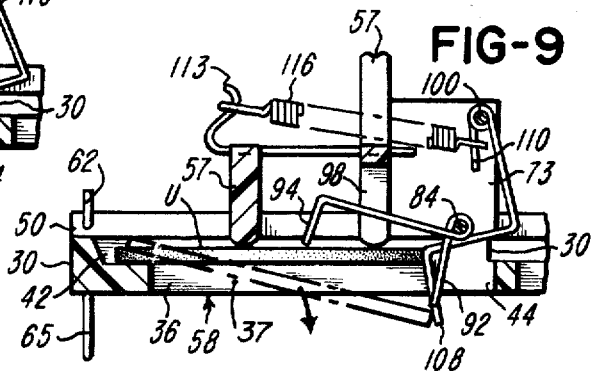
FIG-9
FIG-11
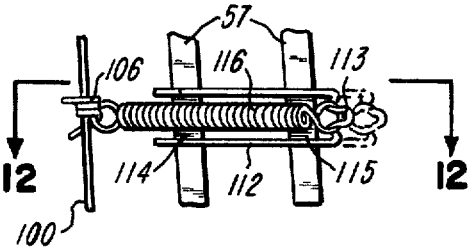
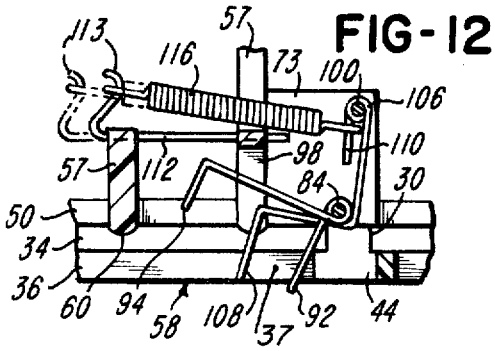
FIG-12

COIN-CHUTE FOR TESTING THE FERROUS CONTENT, WEIGHT, AND PRESENCE OF AN APERTURE IN COINS

BACKGROUND OF THE INVENTION

1. Field of the Invention

The present invention is directed to a ferro-magnetic slug detector, a hole-detector and a coin-weight testing mechanism housed in and forming part of an inclined coin chute.

2. Description of the Prior Art

Hole detectors and coin-weight testing mechanisms which are designed to operate in substantially horizontal coin-pathways are not adapted for use in the substantially vertical coin-receptive channels of an inclined coin chute or the like. Said devices are often exposed to the environment of the associated vending apparatus, and therefore, are highly susceptible to contamination by undesirable elements such as dirt, moisture and the like which are present in many operations such as, by way of example, coin-operated laundries.

SUMMARY OF THE INVENTION

The present invention provides for a ferro-magnetic detector, a hole detector and a coin-weight testing mechanism which are housed in and form part of the coin-receptive channels of an inclined coin chute. The testing devices are not adversely effected by lint, moisture and other forms of contaminants which are present in many coin-operated industries, and will readily withstand vibration or uneven mounting of support structure for the coin chute.

Each channel of the coin chute includes an elongate, through aperture for gauging the diameter of coin-tokens which are advanced therethrough. The devices of the present invention are operable to deflect unacceptable coin-tokens into said aperture, whereby the coin-tokens are ejected from the coin chute.

The ferromagnetic slug detector comprises a permanent magnet which is secured to and carried by each channel whereby the magnet attracts and deflects ferromagnetic coin-tokens into the elongate aperture.

The hole detector includes a projecting finger which is mounted in each channel and is pivotable between advanced and retracted positions, wherein the finger is disposed in interferring and non-interferring relationship with advancing coin-tokens, respectively. The finger is advanced into and strikes the face of the coin-token as it passes in the vicinity of the hole detector. If a hole is detected in the face of the coin-token, the finger is operable to deflect the coin-token into the elongate aperture.

The coin-weight testing mechanism comprises a balanced finger which projects into the channel and is pivotable therefrom when subjected to a force which overcomes the counter weight of the balanced finger. When an authentic, acceptable coin-token is advanced through the channel, the weight of the coin-token is sufficient to overcome the force acting upon the balanced finger, and the finger is deflected out of the channel, whereby the coin-token is free to advance through the chute. An underweight, unacceptable coin-token strikes the finger with insufficient force, whereby the finger intercepts and deflects the coin-token into the elongate aperture.

It is, therefore, a primary object of the present invention to provide means in an inclined coin chute for testing the ferromagnetic content of, the weight of and the presence or lack of apertures in the face of coin-tokens which are present in and are advancing through the coin receptive channels of the coin chute, wherein the testing devices are automatically operable to intercept and eject spurious coin-tokens from the coin chute.

Other objects and features of the present invention will be readily apparent from the drawings and from the detailed description which follows.

BRIEF DESCRIPTION OF THE DRAWINGS

FIG. 5 is a view similar to FIG. 4 and diagrammatically illustrates the advancement of an authentic, acceptable coin-token through the coin chute.

FIG. 6 is a rear elevational view of the coin chute wherein a portion of one channel has been deleted for clarity of detail and understanding.

FIG. 7 is a sectional view taken on line 7—7 of FIG. 6.

FIG. 8 is a view similar to FIG. 7 and illustrates the position of the coin-weight testing mechanism and the hole-detector when intercepted by an advancing authentic coin-token.

FIG. 9 is a view similar to FIG. 8 and illustrates the position of the coin-weight testing mechanism when intercepted by an advancing, underweight slug-token or the like.

FIG. 10 is a view similar to FIG. 8 and illustrates the position of the hole-detector when intercepted by an advancing slug-token or the like having a central aperture therethrough.

FIG. 11 is a fragmentary view taken in the direction of arrow 11 of FIG. 7.

FIG. 12 is a view partly in section taken at line 12—12 of FIG. 11.

DESCRIPTION OF THE PREFERRED EMBODIMENT

Figure 1:
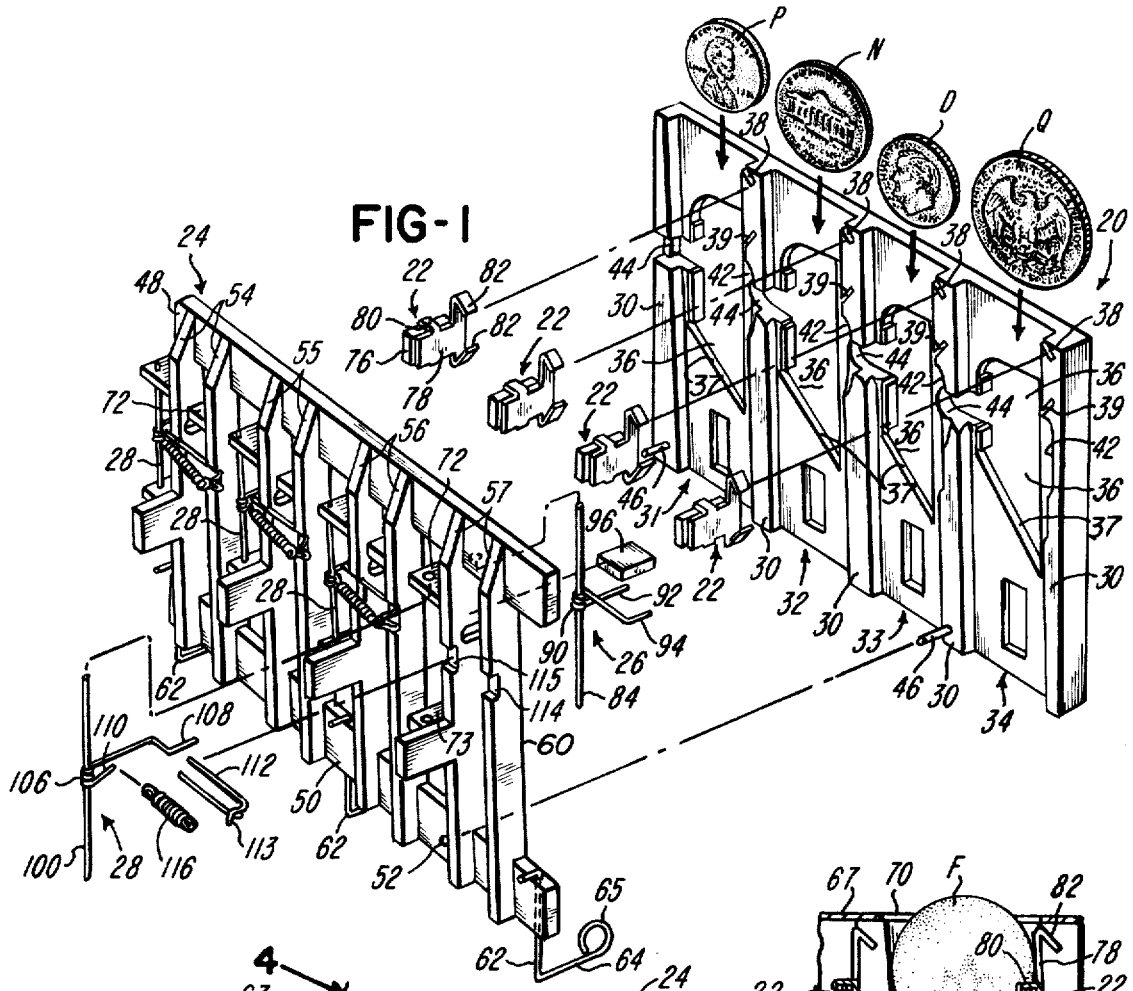
FIG. 1 is an exploded perspective view illustrating the various components of an inclined coin chute which embodies the teachings of the present invention.

An inclined coin chute which embodies the teachings of the present invention is illustrated in FIG. 1. The guide member 20 is separated into a plurality coin-receptive chutes or channels 31, 32, 33 and 34 by a plurality of spaced, substantially parallel, elongate ribs or side walls 30, wherein the chutes 31–34 are accurately sized for receiving specific coin-tokens P, N, D and Q, respectively.

Figure 2:
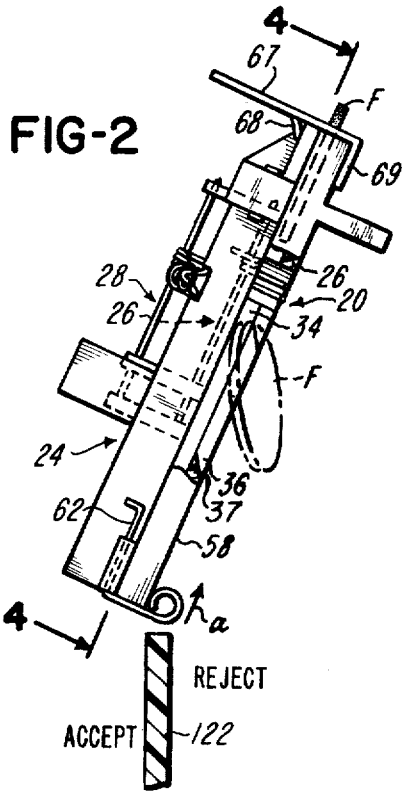
FIG. 2 is a side elevational view of the assembled coin chute of FIG. 1.

The wall of each chute 31–34 includes an elongate, through opening or reject slot 36. Undersize coin-tokens which are inserted in the chutes and do not span opening 36 are discharged therethrough and fall free of the coin chute into a suitable receptacle as diagramatically illustrated by "REJECT" side of wall 122 (FIG. 2).

A plurality of ferromagnetic detectors 22 are adapted to be received by the tapered slots 38, 39 of ribs 30, one each associated with each coin chute 31–34, as shown, for example, in FIGS. 5 and 6. The ribs 30 include elongate channels 42 which are spaced below notches 38–39 and are adjacent openings 36. Ferromagnetic slug-tokens which are inserted in the chutes are detected by ferromagnetic detectors 22, and are deflected into the respective channels 42, afterwhich the ferromagnetic tokens fall through opening 36 and are ejected from the coin chute (see FIG. 4). Other spurious tokens are detected by hole detectors 26, and/or coin-weight testing mechanisms 28 and are intercepted and similarly deflected into opening 36 (see FIGS. 9 and 10).

Figure 4:
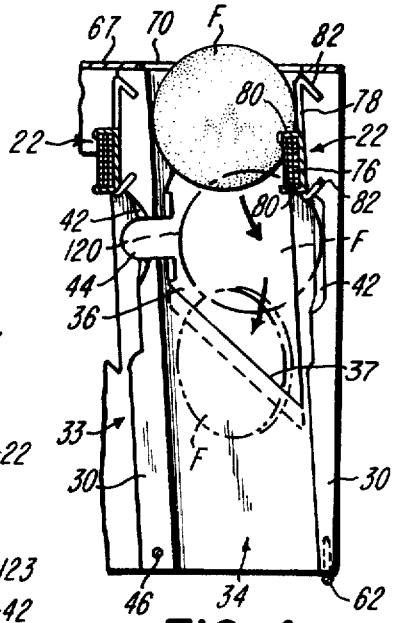
FIG. 4 is a view taken at line 4—4 of FIG. 2 illustrating the path of a spurious coin-token.

It will be noted that the lower edge 37 of opening 36 is inclined. Spurious coin-tokens which are detected by the various testing mechanisms are urged transversley relative to the guide, as shown in FIG. 4, whereby the leading edge of the coin-token falls through the "highest" point of the lower edge.

Cover 24 comprises a pair of spaced, parallel, substantially horizontal cross-members 48 and 50 which are held in rigid, spaced, parallelism with one another by a series of adjacent pairs of upright supports 54—54, 55—55, 56—56 and 57—57. It will be noted that each adjacent pair of supports is associated with one of the chutes 31–34, wherein the innermost edge 60 of each support is accurately spaced from guide member 20 and precludes the insertion of oversize coin-tokens into the chutes (FIGS. 1, 6 and 7).

Figure 3:
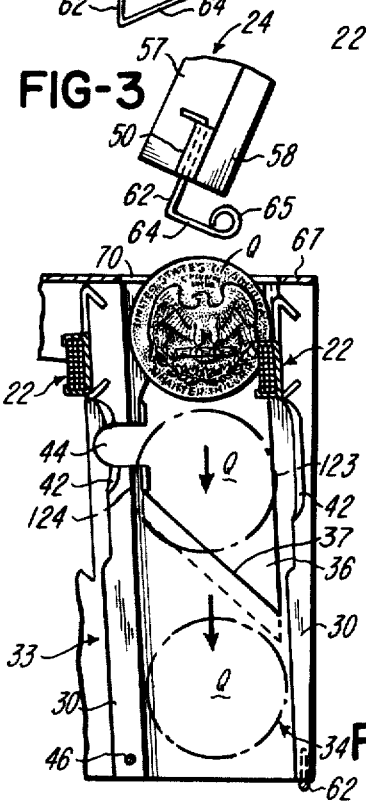
FIG. 3 is a fragmentary view of the lower end of FIG. 2 and illustrates the fastener in an open position.

Cross member 50 includes a plurality of mounting holes 52 which are adapted to accomodate posts 46 of ribs 30, whereby the posts accurately align the cover 24 with the guide member 20. A plurality of depending wire fasteners 62 are mounted for axial movement relative to cross-member 50 (FIGS. 2 and 3). Each wire fastner comprises a stiff, spring-like leg 64 which terminates in closed loop 65, whereby loop 65 resiliently urges guide member 30 and cover 24 into abutting engagement with one another when each fastener 62 is axially advanced into cross-member 50, as diagramatically illustrated by arrow *a* (FIG. 2).

Generally, the assembled guide member 20 and cover 24 are secured to and carried by support frame 67 or the like, wherein the chutes, 31–34 are inclined to ensure that advancing coin-tokens or slug-tokens which are deflected into openings 36 will gravitationally and automatically fall free of the guide member (FIGS. 2 and 3). In the preferred embodiment support frame 67 includes a pair of depending tabs 68, 69 or the like which are adapted to receive and securely hold the upper ends of cover 24 and guide member 20.

As illustrated in FIG. 1, guide member 20, ferromagnetic slug detectors 22, cover 24, hole detectors 26 and coin-weight testing mechanisms 28 may be completely assembled without the use of any tools, wherein ferromagnetic slug detectors 22 are slidably inserted in the respective notches 38, 39 of ribs 30; mounting posts 46 of the ribs 30 are inserted in mounting holes 52 of the cover 24; and wire fasteners 62 are advanced into abutting relationship with the cover and guide member as shown in FIG. 2. The upper ends of the cover and guide member are received by the space between tabs 68, 69 of support frame 67, and posts 84 and 100 of devices 26 and 28, respectively, are slidably inserted in mounting holes which are provided in cover 24 (FIGS. 1, 2, 6 and 7).

THE FERROMAGNETIC SLUG DETECTOR

Each ferromagnetic-slug detector 22 comprises an elongate permanent magnet 76 which is secured to and carried by bracket 78 by suitable means such as, by way of example, rolled-over tabs 80 or the like. Bracket 78 terminates in a pair of outwardly projecting tabs 82 which are securely though releasably accomodated by notches 38, 39 in the ribs 30 of the guide member 20. The permanent magnet 76 of each detector attracts ferromagnetic-slug tokens which are deposited in the corresponding chute 31–34 (FIGS. 2 and 4) and deflects the slug-token into channel 42, afterwhich the slug-token is ejected through opening 36 and falls free of the guide member.

THE HOLE DETECTOR

Each hole-detector 26 comprises an elongate, upstanding rigid post 84. A horizontal support 73 is secured to and carried by each set of upright supports 54–57 of cover 24 (FIGS. 1 and 6), wherein post 84 is rotatably mounted in and is loosely accommodated by the mounting holes 86 and 88 provided in cross member 48 and the support 73, respectively. A stiff, wire-like member 90 is secured to and carried by the post 84 and terminates in a pair of spaced, parallel, outwardly projecting fingers 92, 94 which are normally disposed in open communication with the corresponding chute 31–34, see, for example, FIG. 7.

Biasing means such as, by way of example, the permanent magnet 96 which is secured to and carried by cover 24 by a suitable means such as an adhesive or the like, normally urges the projecting finger 92 into the corresponding chute and into interfering relationship with advancing coin-tokens (FIG. 7). Finger 94 is normally urged out of the path of the coin tokens. Slots or channels 98 in certain of the upright members 54–57 (FIGS. 7–10) provide clearance for finger 92 as it swings into and out of the chute. Notch 44 is provided in each chute adjacent the aperture 36 and provides clearance for finger 94 (FIGS. 7–10).

Coin-tokens which are advanced through the chute strike finger 92 and overcome the force of magnet 96 thereon, whereby finger 92 is deflected into notch 44 (FIG. 8) and finger 94 is advanced into the chute and strikes the face of the coin-token. If a hole is present in the face of the coin-token, finger 94 is advanced into and received by the hole (FIG. 10), whereby the coin-token strikes the finger and is deflected into aperture 36. Where an authentic coin-token is advanced through the chute, finger 94 strikes the face of but does not intercept the coin-token, and the coin-token is free to advance through the chute (FIG. 8).

THE COIN-WEIGHT TESTING MECHANISM

Each coin-weight testing mechanism 28 comprises an elongate, upstanding rigid post 100. A horizontal support bracket 72 is secured to and carried by each set of upright supports 54–57 of cover 24 and is spaced upwardly from the support bracket 72 (FIGS. 1 and 6), wherein post 100 is rotatably mounted in and loosely accomodated by the mounting holes 102 and 104 provided in the brackets 72, 73 respectively. A stiff, wire-like member 106 is secured to and carried by the post 100 and terminates in the projecting, elongate, Z-shaped finger 108 and a short, hook-defining member 110. The finger 108 is in open communication with the corresponding chute and is normally urged into interfering relationship with coin-tokens which are advancing therethrough.

Biasing means, such as, by way of example, the calibrated, adjustable tension spring 116 is secured to hook 110 for resiliently urging finger 108 into the corresponding chute for intercepting advancing coin-tokens (FIG. 7). The spring is calibrated and is operable to respond to a predetermined force provided by an authentic, advancing coin-token, whereby the coin-token deflects finger 108 out of the chute. After the coin-token has passed, the tension spring 116 automatically returns finger 108 to the position of FIG. 7.

The calibrated, adjustable tension spring 116 is mounted in cover 24 by means of the U-shaped bracket 112 which is slidably mounted in channels 114, 115 of each pair of upstanding members 54–57 (FIGS. 7 and 11). The bracket includes an integral hook 113, wherein one of the ends of spring 116 is secured to hook 110 and the other end of the spring is secured to hook 113 for normally urging finger 108 into the path of advancing coin-tokens. The bracket may be slidably adjusted relative to the upstanding members for calibrating the tension spring 116 (FIGS. 11 and 12), whereby weighted finger 108 readily responds to the force provided by various advancing coin-tokens P, N, D and Q.

When an authentic coin-token is inserted in the chute, it strikes finger 108 with a force sufficient to overcome the tension force of spring 116, and swings finger 108 into notch 44 (FIG. 8), whereby the coin-token is free to advance through the chute. A spurious, underweight coin-token strikes finger 108 with insufficient force to overcome the tension force of spring 116, whereby finger 108 intercepts the spurious, underweight coin-token and deflects same into aperture 36 (FIG. 9).

OPERATIONAL MODE

Coin tokens P, N, D and Q or the like are deposited in the respective chutes 31–34 and tested for thickness by guide 20 and edges 60 of cover 24, for diameter by aperture 36, for ferromagnetic content by detectors 22, for the presence of a central aperture in the face of the coin-token by detectors 26 and for weight by mechanism 28.

As illustrated in FIG. 5, the authentic coin-token Q which is deposited in and advancing through chute 34 is of sufficient diameter to properly engage the guide member 20 at 123, 124 and bypass opening 36 thereof. The authentic coin-token Q is not attracted by magnet 76 (FIG. 5), compensates for the force of spring 116 on finger 108 whereby finger 108 swings out of the coin path of coin-slide 34 (FIG. 8), and is not intercepted and deflected by finger 92 of the hole detector when said finger is advanced into the slide 34 (FIG. 8). After coin-token Q has successfully passed each of the devices 22, 26 and 28, biasing means 96 and 116 automatically return the projecting fingers 92, 94 and 108 to their normal position (FIG. 7) and the accepted coin-token passes through the chute and is deposited in a suitable depository as diagramatically illustrated by the "ACCEPT" side of the upstanding partition 122 (FIG. 2).

When spurious coin-tokens such as thhe ferromagnetic slug F (FIGS. 2 and 4), the underweight slug U (FIG. 9), and/or the ring-shaped slug H (FIG. 10) are deposited in the coin chute, the various testing devices 22, 26 and 28 are operable to detect the presence thereof and to deflect each slug into channel 42, whereby one edge thereof is disengaged from slide member 20, and the slug falls through opening 36 and is ejected from the coin-chute as a rejected token, as illustrated at the REJECT side of partition 122 (FIG. 2).

Referring particularly to FIGS. 2 and 4, the ferromagnetic slug F is attracted by magnet 76 of the slug detector 22 and is urged into elongate channel 42. The periphery of the slug is disengaged from guide member 20 at 120 (FIG. 4) and falls through opening 36.

As shown in FIG. 9, the underweight slug U is not ferromagnetic and successfully passes the magnet 76 of slug detector 22. The slug strikes the projecting finger 108 of coin weight-testing mechanism 28 with insufficient force to overcome the tension force of spring 116. The slug is deflected by the finger into channel 42 whereby the slug is disengaged from guide member 20 and falls through opening 36.

As shown in FIG. 10, the ring-shaped slug H successfully passes slug detector 22 and strikes finger 108 of device 28 with sufficient force to overcome the tension force of spring 116. The slug H strikes finger 92 of the hole detector and deflects the finger into notch 44. Finger 94 advances into the chute and strikes the face of the slug. As the slug continues to advance in the chute, the finger 94 is received by hole 130 and the peripheral edge of the hole strikes the finger, whereby the finger 94 intercepts the advancing slug H and deflects the slug into channel 42. The slug falls into aperture 36 through which it is ejected from the coin-chute.

It should, of course, be understood that biasing means 96 and 116 automatically return the projecting fingers 92, 94 and 108 of the hole detector 26 and the coin weight testing mechanism 28, respectively, to their normal positions when the slugs are ejected from the coin chute.

What is claimed is:

1. A coin-chute having an upper coin-token receptive end, an intermediate coin-token testing portion, and a lower discharge end for acceptable coin-tokens, comprising a. an inclined guide for slidably supporting a face of a coin-token, wherein said guide includes an elongate aperture having a lower edge, said aperture located in said intermediate testing portion and defining an area through which spurious coin-tokens are rejected;

b. first means in said intermediate portion for detecting and ejecting spurious coin-tokens having a ferrous content;

c. second means in said intermediate portion for detecting and ejecting spurious coin-tokens having an aperture therethrough; and d. third means in said intermediate portion for detecting and ejecting spurious coin-tokens having less than a predetermined weight, e. wherein said guide includes a pair of side walls laterally spaced to accommodate the diameter of an acceptable coin-token, one of said walls being discontinuous adjacent said elongate aperture, wherein coin-tokens deflected by any of said means are shifted transversely of said guide from the other of said side walls, for gravitationally urging the coin-token into said aperture.

2. A coin-chute as called for in Claim 1, wherein each of said first, second and third means is operable to deflect a leading edge of a spurious coin-token rearwardly of the lower edge of said elongate aperture.

3. A coin-chute as called for in claim 1, wherein the lower-edge of the elongate aperture is inclined downwardly from the said other side wall toward the said discontinuous side wall.

4. A coin-chute as called for in claim 1, wherein said elongate aperture is dimensioned to eject advancing, spurious coin-tokens of less than predetermined diameter.

5. A coin-chute as called for in claim 1, wherein said first means comprises a magnet adjacent the discontinuous side wall of said guide for attracting and shifting a spurious coin-token transversely of the guide.

6. A coin-chute as called for in claim 1, wherein said second means comprises:

a. an elongate, stiff, wire-like member mounted for pivotal movement relative to said guide, including a free outer end movable between coin-face engaging and disengaging positions;

b. biasing means normally urging the free outer end into disengaging-position; and c. means operable in response to the presence of a coin-token in the intermediate testing portion of the guide for advancing the free outer end of said member to coin-token face engaging position whereby to enter an aperture in a spurious coin-token and shift the coin-token transversely of the guide.

7. A coin-chute as called for in claim 6, wherein:

a. said wire-like member includes a second free, outer end movable between coin-token edge intercepting and non-intercepting positions; wherein b. said biasing means normally urges the first mentioned and said second free outer ends of the member into coin-token face disengaging and coin-token edge intercepting positions, respectively; and wherein c. said second free outer end of the member is operable, when struck by an advancing coin-token, to move to non-intercepting position, thereby advancing the first mentioned free outer end of the member into coin-token face engaging position.

8. A coin-chute as called for in claim 6, which includes:

a. an elongate shaft mounted for rotational movement in a plane substantially parallel with said guide; wherein b. said wire-like member is secured to, carried by and projects radially outward from said shaft; and wherein c. the biasing means comprises a magnet secured relative said shaft for normally urging the free outer end of said member into coin-token face disengaging position.

9. A coin-chute as called for in claim 1, wherein said third means comprises:

a. an elongate, stiff, wire-like member mounted for pivotal movement relative to said guide, including a free outer end movable between coin-token edge intercepting and non-intercepting positions; and b. means resiliently urging the free outer end of said member into coin-token edge intercepting position with a predetermined force such that an advancing coin-token of predetermined weight will strike the free outer end of said member with sufficient force to move the free outer end of member to non-intercepting position, allowing the coin-token to be advanced to the lower, discharge end of the coin-chute, whereas an advancing coin-token of less than predetermined weight is intercepted by the free outer end of said member and is shifted transversely of said guide.

10. A coin-chute as called for in claim 9, wherein the resilient means comprises an elongate tension spring having opposite ends secured to the wire-like member and said guide.

11. A coin-chute as called for in claim 9, wherein said resilient means is adjustable for exerting a specific, predetermined tension force which is a function of the weight of a specific coin-token.

12. A coin-chute as called for in claim 9, which includes:

a. an elongate shaft mounted for rotational movement in a plane substantially parallel with said guide; wherein b. said wire-like member is secured to, carried by and projects radially from said shaft.

13. A coin-chute as called for in claim 1, which includes means disposed in spaced parallelism with said guide precluding the introduction of coin-tokens of greater than predetermined thickness into the upper end of said coin-chute.

14. A coin-chute as called for in claim 1, which includes:

a. a plurality of outwardly projecting posts secured to and carried by said guide;

b. a cover disposed in spaced parallelism with said guide, including a plurality of mounting holes for receiving said posts; and c. a plurality of spring-like clamps securely though releasably maintaining the guide and cover in assembled relationship.

15. A coin-chute as called for in claim 14, wherein said clamps are secured to and carried by said cover, and are releasably engageable with said guide for facilitating assembly and disassembly of the coin-chute.

16. A coin-chute as called for in claim 14, wherein each of said clamps comprises a stiff, substantially L-shaped, wire-like element, having:

a. an upstanding leg carried by and mounted for axial movement in said cover in a plane substantially parallel with said guide;

b. a substantially horizontal leg projecting outward from the unstanding leg toward said guide; and c. an upwardly turned, spring-like loop at a free outer end of the horizontal leg adapted for engaging a rear wall of said guide for securely, though releasably, urging said guide into abutting engagement with said cover.

17. A coin-chute as called for in claim 14, wherein each of said second and third means is mounted in said cover and includes:

a. an elongate shaft securely though releasably mounted for axial rotation in the cover in a plane substantially parallel to said guide;

b. an elongate, stiff, wire-like member secured to, carried by and projecting radially outward from the shaft, having a free outer end which is movable between coin-token edge intercepting and non-intercepting positions; and c. resilient means normally urging the free outer end of said member into coin-token edge intercepting position.

18. A coin-chute as called for in claim 17, wherein said second means further includes:

a. a magnet mounted in said cover normally urging the said outer end of said member into coin-token edge intercepting position; wherein b. said wire like member includes another free outer end which is movable between coin-token face engaging and disengaging positions; and wherein c. the first mentioned outer end of said member is operable, when struck by an advancing coin-token, to move from edge intercepting to non-intercepting position for shifting the other outer end of said member to coin-token face engaging position for detecting the presence of an aperture in a spurious coin-token.

19. A coin-chute as called for in claim 17, wherein said third means further includes an elongate tension spring securely though releasably mounted in said cover exerting a force on said wire-like member which is a function of the weight of a predetermined, authentic coin-token, whereby the free outer end of said member, when struck by an authentic coin-token, is moved to the non-intercepting position, and is operable, when struck by an underweight spurious coin-token, to intercept and eject same from the coin-chute.

20. A coin-chute as called for in claim 1, wherein:

a. said guide is subdivided into a plurality of coin-receptive channels disposed in parallel, side-by-side relationship, each of said channels adapted for receiving and advancing a specific, coin-token toward the lower discharge end of the coin-chute; and wherein b. first, second and third means are disposed in one-to-one correspondence with said channels for detecting and ejecting spurious coin-tokens.

21. A coin-chute having an upper coin-token receptive end, an intermediate coin-token testing portion, and a lower discharge end for acceptable coin-tokens, comprising:

a. a guide for slidably supporting a face of a coin-token, wherein said guide includes an elongate aperture having a lower edge, said aperture located in said intermediate testing portion and defining an area through which spurious coin-tokens are rejected, and a pair of side walls laterally spaced to accommodate the diameter of an acceptable coin-token, one of said walls being discontinuous adjacent said elongate aperture;

b. a cover securely though releasably mounted in abutting relationship with said side walls and spaced from said guide to accommodate the thickness of an acceptable coin-token;

c. a magnet releasably mounted in said discontinuous side wall adjacent the elongate aperture and secured therein by said cover for attracting and shifting spurious coin-tokens of ferrous content transversely of said guide toward said discontinuous side wall for gravitationally urging the coin-tokens into said elongate aperture;

d. means securely though releasably mounted in said cover adjacent the intermediate testing portion of the coin-chute for intercepting and shifting spurious coin-tokens having an aperture therethrough transversely of said guide toward said discontinuous side wall for gravitationally urging the coin-tokens into said elongate aperture; and e. means securely though releasably mounted in said cover adjacent the intermediate testing portion of the coin-chute for intercepting and shifting spurious coin-tokens of less than predetermined weight transversely of said guide toward said discontinuous side wall for gravitationally urging the coin-tokens into said elongate aperture.

22. A coin-chute as called for in claim 21, wherein said elongate aperture is dimensioned to eject spurious coin-token of less than predetermined diameter from said coin-chute.

23. A coin-chute as called for in claim 21, wherein the lower-edge of said elongate aperture is inclined downwardly from said other side wall toward said discontinuous side wall.

* * * * *